United States Patent [19]

Elliesen

[11] Patent Number: 4,609,135

[45] Date of Patent: Sep. 2, 1986

[54] SOUND-DAMPENED DRIVING APPARATUS FOR FASTENERS

[75] Inventor: Wolfgang Elliesen, Ahrensburg, Fed. Rep. of Germany

[73] Assignee: Joh. Friedrich Behrens AG, Fed. Rep. of Germany

[21] Appl. No.: 663,694

[22] Filed: Oct. 22, 1984

Related U.S. Application Data

[62] Division of Ser. No. 379,970, May 19, 1982, Pat. No. 4,509,669.

[30] Foreign Application Priority Data

May 20, 1981 [DE] Fed. Rep. of Germany ..... 3119956

[51] Int. Cl.[4] ..... B25C 1/04

[52] U.S. Cl. ..... 227/130; 92/85 R; 188/322.22; 173/DIG. 2

[58] Field of Search ..... 173/139, DIG. 2; 227/8, 227/120, 130, 156; 92/85 R; 188/322.11, 322.22

[56] References Cited

U.S. PATENT DOCUMENTS

| | | | |
|---|---|---|---|
| 3,086,207 | 4/1963 | Lingle et al. | 227/130 |
| 3,162,097 | 12/1964 | Allen et al. | 227/130 X |
| 3,205,787 | 9/1965 | Volkmann | 227/130 X |
| 3,352,471 | 11/1967 | Fisher | 227/130 X |
| 3,387,541 | 6/1968 | Bade | 227/130 X |
| 3,403,600 | 10/1968 | Bade | 227/130 X |
| 3,496,840 | 2/1970 | Wandel et al. | 227/130 X |
| 3,969,989 | 7/1976 | Maurer et al. | 227/130 X |
| 4,441,644 | 4/1984 | Farian | 227/130 |

*Primary Examiner*—Paul A. Bell

*Attorney, Agent, or Firm*—Emrich & Dithmar

[57] ABSTRACT

The present invention relates to a sound-dampened driving apparatus for fasteners wherein a main valve means is arranged above a working cylinder of the apparatus and movable within a cylindrical bore. When the main valve means is in its lower at rest position, the main valve means separates the working cylinder from a source of compressed air and connects the cylinder to the atmosphere. When the main valve means is in its upper actuating position, the working cylinder is connected to the source of compressed air and the valve means blocks the cylinder connection to the atmosphere. The space above the main valve member within the cylindrical bore is capable of being alternately connected to either the atmosphere or compressed air, and includes a sound dampening means arranged in the space above the main valve member.

6 Claims, 3 Drawing Figures

SOUND-DAMPENED DRIVING APPARATUS FOR FASTENERS

This is a division of application Ser. No. 379,970, filed May 19, 1982 now U.S. Pat. No. 4,509,669.

BACKGROUND OF THE INVENTION

The present invention relates to a sound-dampened driving apparatus for fasteners wherein a main valve means is arranged above a working cylinder of the apparatus and movable within a cylindrical bore. When the main valve means is in its lower at rest position, the main valve means separates the working cylinder from a source of compressed air and connects the cylinder to the atmosphere. When the main valve means is in its upper actuating position, the working cylinder is connected to the source of compressed air and the valve means blocks the cylinder connection to the atmosphere. The space above the main valve member within the cylindrical bore is capable of being alternately connected to either the atmosphere or compressed air, and includes a sound dampening means arranged in the space above the main valve member.

Compressed air-operated driving apparatuses for fasteners serve to process fasteners, such as staples, nails, pins and screws, and drive the same into a workpiece. A complete working cycle of such driving apparatuses is composed of a driving and a blow-out phase. During the driving phase, a piston is driven by compressed air, after the opening of the auxiliary controlled main valve, and is highly accelerated. A fastener is positioned in the path of the piston stroke and driving into the workpiece by the accelerated piston in the driving phase. The residual excess energy of the piston which is not used during the driving operation or phase, is generally intercepted at the end of the stroke by a buffer element. During the blow-out phase, the working piston returns to its initial starting position thereby forcing the air present in the working cylinder into the atmosphere.

Both working cycles of these driving apparatuses generate pulse-like airborne sounds and sounds conducted through the housing solids of different intensity. The intensity level of airborne sound which is radiated in the driving phase is created by the piston striking against the buffer element at the end of the stroke. In the blow-out phase, the radio-frequency noises are caused by the outflowing compressed air from the apparatus.

It has been suggested to reduce the radiation of noises from such devices during the blow-out phase by suitable sound absorbers. For example, it is known to use as a sound absorber a thin perforated plastic ring (German disclosure letter No. 24 22 222) or a tightly pressed wire cloth (German disclosure letter No. 27 24 220). It has been suggested also to discharge the outflowing compressed air via a two-chamber system (German disclosure letter No. 28 27 279. Also, in view of the noise emission, it has been suggested to intercept the piston in the driving phase in such a manner that the braking step is timely extended. With one known driving apparatus, this is obtained with the aid of an air cushioning arrangement (German disclosure letter No. 25 04 094). The construction necessary for this, however, results in bulky driving apparatuses which are costly and prone to trouble.

It has also been suggested, in connection with a driving apparatus, to attach a ring of polyurethane foam material to the underside of the driving piston, with the ring striking against a buffer element of crosslinked polyurethane of a predetermined Shore hardness positioned in the cylinder at the end of the stroke. However, examinations have shown that an effective dissipation of the percussion energies and, accordingly, an optimum reduction of the airborne sound oscillations and the oscillations of sound conducted through solids can be obtained only by stretching the energy/time pattern during this braking step. In the case of this known arrangement, this is obtained only because of an extended braking path and increased mass of body. Because the mass of the body connected to the piston and the brake path provide for the dissipation of the energy of percussion are too small, a soft dampening by the foam material dampening element will not occur. Accordingly, the dampening will be taken over almost exclusively by the hard buffer element on a very short brake path (German publication letter No. 23 39 163), a result which is insatisfactory.

It has also been suggested to design a buffer element in such a manner that in cooperation with the driving piston, the buffer element will experience a radial stretching (German disclosure letter No. 25 10 858). This known arrangement, too, suffers from several drawbacks. Owing to the central accumulation of the mass of the buffer element, a radial stretching takes place only due to a very high energy of percussion, such as occurs in connection with free shots. The residual energies which are not consumed in the driving operation or phase, do not effect a radial deformation of the buffer element, so that a shock-like and relatively hard dampening will result from normal operation. Also, the deformation of the buffer elements results in a considerable development of heat through internal frictional heat during the performance of the work of deformation. Accordingly, the working life of such buffer elements are negatively influenced and such devices are commercially unacceptable.

Another source of the development of noise during the driving phase lies in the movement of the valve member of the main valve. This is true, especially in connection with apparatuses having a high driving capacity. The resultant change in acceleration of the main valve member leads to shock-like braking operations which are effective to cause the development of a considerable noise. In addition, this process results in a considerable rebounding effect of the apparatus handle which the operator effectively feels. To overcome these problems, it has been suggested to position at the inner surface of the cap of the cylinder housing a dampening ring of soft material against which the main valve member strikes when being adjusted into the opening direction. Although such structures are intended to displace the bouncing noise in a direction towards the low frequency range, however, decisive noise dampening effects are not obtained, and such structures do not provide satisfactory dampening of the rebounding shock. Additionally, it has been suggested to compensate the rebound caused by the main valve member by a housing cap having a high specific gravity. This, however, results in a displacement of the center of gravity, and the apparatuses become top-heavy. By this measure, thus the operational comfort is rendered worse. Especially, in the case of heavy apparatuses, with the weight unbalanced, the wrist of the operator is considerably stressed.

SUMMARY OF THE INVENTION

It is one object of the present invention to provide a sound-dampened driving apparatus for fasteners which provides an efficient means for sound and oscillation dampening of the driving apparatus during the driving phase and blow-out phase.

In the present invention, a delaying or dampening disc is movably supported, for limited axial movement, above the main valve member within a cylindrical bore, and a resiliently elastic dampening material is arranged between the delaying or dampening disc and the facing wall of the housing cylindrical bore. Preferably, the delaying disc is a relatively small, yet movable mass in order to obtain the novel sound dampening and rebound elimination of the present invention. The direction of movement of the delaying disc is opposed to the direction of movement of the main valve member. This is due to the fact that, in a known manner, the space in the cylindrical bore above the valve member is alternately, predeterminedly connected to compressed air or to the atmosphere. To initiate the opening process, this space is evacuated to the atmosphere to permit the valve member to lift from the cylinder and move in the direction into the cylindrical bore of the housing cap. The delaying disc which, for its part, lies against the resiliently elastic dampening material, is moved by the dampening material in the direction towards the valve member, whereby the movement of the valve member is more or less braked and both parts, the valve member and the delaying disc, continue the original direction of movement of the valve member, until the delaying disc comes again to lie in close contacting engagement against the dampening material under deformation of the latter.

With the structure as described above, it is possible to achieve a timely extended braking of the valve member, in which shock-like impacts are dampened in that the delaying disc on the one hand and the valve member on the other hand are formed of different materials. Preferably, the main valve member according to one embodiment of the invention is formed of a relatively soft material, preferably synthetic material, while the delaying disc is formed of a relatively heavy material, preferably brass. The individual components may be dimensioned such that the braking operation proper of the main valve member takes place at a point in time at which the piston impinges upon the lower buffer element. As this impact is by far stronger than the rebound caused by the valve member, it therefore provides a structure which completely compensates for the rebound of the piston on the blow-out phase.

In another embodiment of the present invention, an O-ring is positioned between the delaying disc and the housing wall. This O-ring serves on the one hand as a noise-dampening abutment for the delaying disc and, on the other hand, as a springing means which biases the delaying disc in a direction towards the main valve member. However, it is within the scope of the present invention that the O-ring may be arranged in an annular groove in the upper surface of the delaying disc as well as in the housing proper, provision being preferably made in another embodiment of the present invention for the O-ring to be seated in an annular groove of the housing wall. Because the delaying disc and the main valve member in their oppositely directed movements are bumping into one another, a further embodiment according to the present invention includes the positioning of projections or similar elevations either on the upper surface of the main valve member or upon the lower surface of the delaying disk. And, it is within the scope of the present invention that the knobs or projections may be separate members of an elastomeric material, for example, in annular grooves of the delaying disc or of the valve member.

As has already been set forth above, the impingement of the driving piston with its residual energy or, in case of free shots, with its full energy upon a lower buffer element constitutes a considerable source of noise in driving apparatuses. Accordingly, it is a further embodiment of the present invention for a first section and a second section of such a buffer element to be shaped and structured in such a manner that they are sequentially deformed one after the other upon the impingement and engagement by the driving piston. Specifically, in driving apparatuses there is only a relatively short distance or length available for the braking of the driving piston at the end of its stroke. Therefore, it is inefficient in designing a buffer element to design the same to be relatively soft in order to avoid hard impacts. In such a case of a soft buffer element, having performed relatively little work upon deformation, the driving plunger strikes against a "stop", thereby generating again an impact or blow. On the other hand, a relatively hard buffer material when used for braking purposes, leads to relatively hard blows upon impact by the piston. Thus, the present invention provides for two different sections of the buffer element against which the driving piston comes to sequentially engage in close contact at the end of the stroke. When the residual energy at the end of the stroke is relatively small, then only the first section is contacted by the driving piston to perform the contacts braking work. When the residual energy is greater, such as in case of a free shot, the second section will be engaged also in the braking action to stop and brake the driving piston. Thus, it has been found that only a driving piston which is braked by work of deformation over the entire range of the residual energy occurring will cause no blows or any shock-like interception through which very high oscillation amplitudes are known to be created.

In another embodiment of the present invention, provision is made for an inner and an outer section to be formed by two radially spaced coaxially extending beads. Preferably, the driving piston first contacts with the inner bead radially deforming it. In the case of a greater residual energy, the outer bead will then be more or less upset axially. With the aid of such a design of the dampening element, a timely extension of the braking operation may be effected in a sufficient manner in order to optimize the dampening effect of the present invention.

Provision is made in the present invention for two radially spaced coaxially extending beads to be formed also on the underside of the intergrally formed buffer element with the inner bead portion cooperating with the conical tapered outer surface of a guide member. The guide member serves to safely guide the driving plunger fastened to the driving piston to permit the same to drive the fastener into the workpiece. The guide member is preferably provided with a conical tapered outer surface so that upon movement of the entire dampening ring in a downward direction, the inner bead portion will be expanded radially and will contribute to an effective braking of the driving piston.

The downward pressing movement of the dampening ring caused by the engagement by the driving piston results in a compression of the air in the interspace between the wall of the piston cylinder, the dampening ring and the cylinder bottom end. To permit this air to escape, provision is made in the invention for at least one, preferably several, circumferentially spaced fins to be provided on the outer surface of the buffer element which are lying in close contact against the wall of the piston cylinder. Through the gaps formed by the fins, the air escapes upwards from the mentioned annular space beneath the buffer element. This air is relatively hot because of the heating of the dampening element due to the internal friction the material experiences during the braking of the piston. Thus, if upon the return of the driving piston during the blow-out phase, the buffer element relaxes again and moves upwardly thereby increasing the annular space. This permits cooler air to flow past the dampening element into the lower annular space and thereby cool the dampening element.

Also, as a further dampening measure, structure is provided by the present invention for a dampening member of heavy or resiliently yielding material to be positioned in the lower cylinder bottom end beneath the buffer element. Preferably, this dampening member includes fins or similar projections on the under side thereof so that the area of transmission for sound conducted through solids assumes only minor dimensions.

Other and further objects of the present invention will be apparent from the following description and claims and are illustrated in the accompanying drawings which, by way of illustration, show the preferred embodiment of the present invention and the principles thereof, and what I now consider to be the best mode in which I have contemplated applying these principles. Other embodiments of the present invention embodying the same or equivalent principles may be used and structural changes may be made as desired by those skilled in the art without departing from the present invention and the purview of the appended claims.

DETAILED DESCRIPTION

Figure 1:
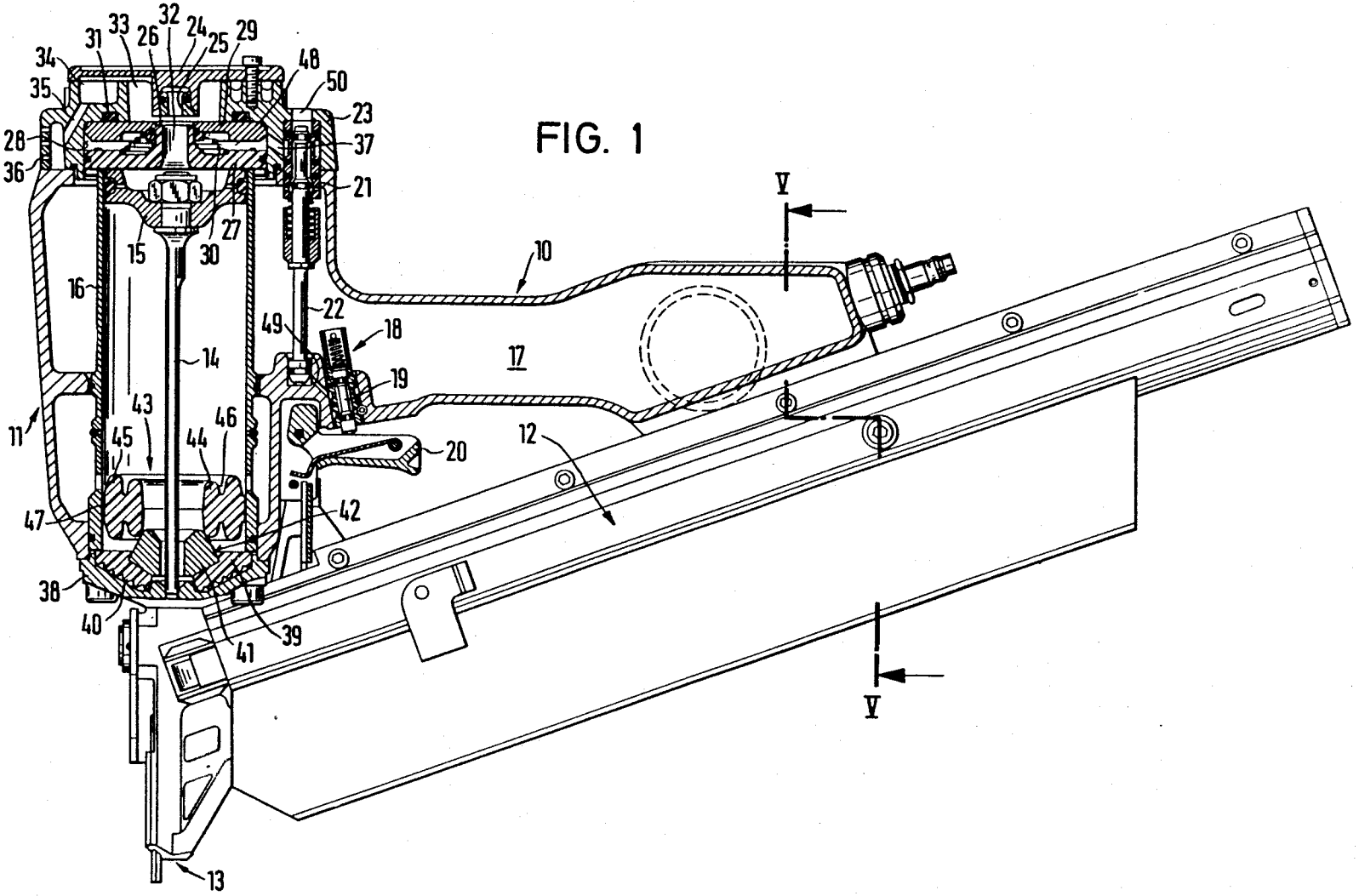
FIG. 1 is a cross-sectional side view of the driving apparatus in accordance with the present invention.

Before enlarging in more detail on the individual representations in the drawings, it is pointed out that each feature is of inventive importance in and of itself. Referring now to the drawings wherein like numerals have been used throughout to indicate the same or similar parts, the driving apparatus includes a handle housing 10, a cylindrical shaped head housing 11, a magazine 12 for fasteners and a muzzle tool 13 having a shooting channel (not shown) for the driving plunger 14 which is mounted to the driving piston 15. The driving apparatus is adapted to propel a fastener, staple or the like into a workpiece. The driving piston 15 is guided by means of a working piston cylinder 16 positioned in the cylinder head housing 11 in a manner known in the art. Accordingly, the necessary sealing effects therebetween will not be dealt with in the present description.

The handle housing 10 defines a compressed air reservoir 17. A release valve 18 is positioned in the handle housing, the valve slide portion 19 thereof is actuated with the aid of a release lever or trigger 20, as is known in the art. Additionally, a control valve 21 is positioned in the handle housing 10, which includes an axially movable valve slide 22, details of which will be enlarged upon in connection with the description of the function of the apparatus being described.

The upper surface of the cylinder-head housing 11 and the piston cylinder 16, respectively, are closed by a cap 23 which is fastened to the cylinder-head housing 11. The cap 23 which for its part opens upwardly and is closed by an end plate 24 respectively accommodating in an axial flange or the blind bore thereof a bushing-like valve seat element 25. The valve seat element 25 cooperates with a pierced axial flange extension 26 of a main valve member 27, which is movable in a cylindrical bore 28 of the cap 23 of the heat housing 11 and sealingly supported therein. In the at rest position, the valve member 27 lies against the end face of the cylinder 16, the position as shown in FIG. 1.

Positioned above the main valve member 27 within the cylindrical bore 28 is a delaying or dampening disc 29. While the main valve member 27 is comprised of a relatively light and solid synthetic material, the delaying disc 29 is comprised preferably of a heavy material such as brass, for example. The delaying disc 29 has a central opening therein, with the axial flange extension 26 of the valve member 27 sealingly by use of an O-ring extended therethrough. A conical spring 30 is positioned between the valve member 27 and the delaying disc 29, said spring tending to force both members apart. In the inner surface of the cylindrical bore 28, an O-ring 31 is fitted in an annular groove thereof which, in the relaxed condition, in part projects into the bore 28 (in this connection see FIG. 2). In the position of the individual members as shown in FIG. 1, the opening 32 of the valve member 27 communicates with the atmosphere via a first changer 33 in the cap 23 and a second chamber 34 connected thereto and via a channel 35 as well as a shock absorber 36, as best shown in FIG. 2.

Figure 2:
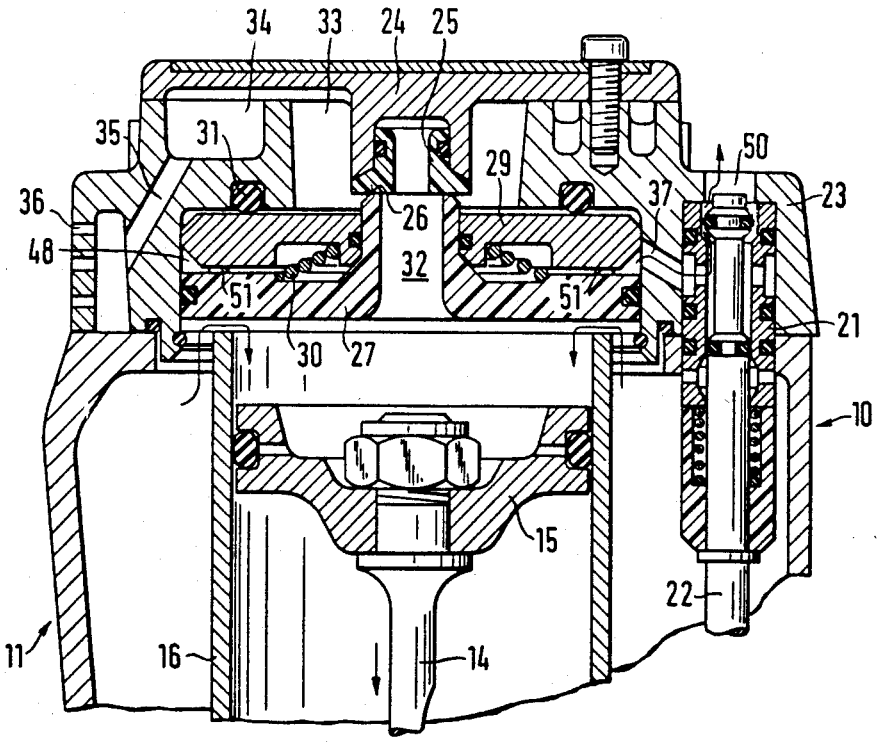
FIG. 2 is an enlarged fragmentary view of the head portion of the driving apparatus showing the downward movement of the piston in accordance with the present invention.
Figure 3:
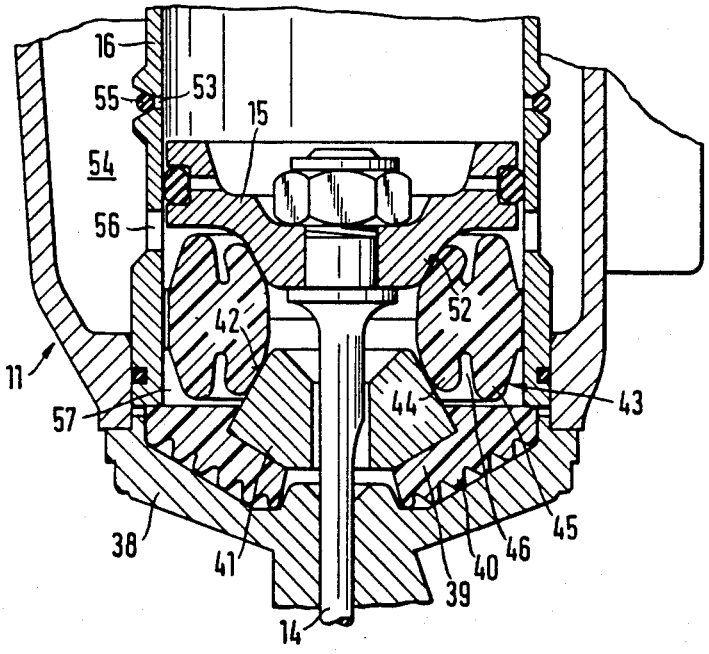
FIG. 3 is an enlarged fragmentary view of the piston at the bottom of its stroke engaging the buffering element to brake the same in accordance with the present invention.
Figure 4:
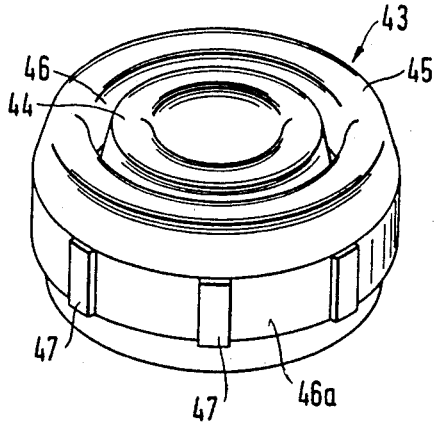
FIG. 4 is a perspective view of the buffer element of the driving apparatus in accordance with the present invention.

The cylinder-head housing 11 and piston cylinder 16, respectively, are closed at the lower end thereof by an end cap 38 (FIGS. 1 and 3). Supported on the inner surface of the bottom cap 38 is a damping member 39 comprised of a relatively heavy synthetic material. The dampening member 39 preferably includes a cross-sectional tooth-shaped circumferentially extending rib 40 over which it is supported on the bottom cap 38. Seated in a recess of the dampening member 39 is an annular guide member 41 which has a central opening for the guidance of the driving plunger 14 as well as a downwardly diverging tapered conical area 42 on its outer surface. A buffer ring 43 is positioned above the dampening member 39, which is symmetrical with respect to its transverse axis. The buffer ring 43 (FIG. 4) has an inner annular bead portion 44 and an outer annular bead portion 45, said beads 44, 45 being separated from each other by an annular rib 46 and corresponding beads 44, 45 (not shown) are formed at the underside of the buffer ring 43. The lower inner annular bead 44 in the relaxed condition (FIG. 1) abuts against the conical outer surface 42 of the guide member 41. As shown in FIG. 4, the outer surface of the buffer ring 43 is provided with a cylindrical area 46*a* in the center region thereof and having webs 47 integrally formed thereon in circumferentially spaced arrangement. The webs 47 lie in close contact against the inner wall of the piston cylinder 16 thereby enabling a passage of air from top to bottom and vice versa.

To understand the mode of operation of the described apparatus, when the apparatus is in the position as shown in FIG. 1, the hand lever, trigger or release lever 20 is unactuated. The position of the valve slide of the control valve 21 enables a biasing of the space 48 between the delaying disc 29 and the valve member 27 with the pressure of the reservoir 17 via the bore 37 in the housing cap 23. The bottom surface of the valve member 27 is, therefore, urged against the valve seat at the cylinder 16. On the other hand, the pressure of the reservoir 17 also bears on the outer annular portion of the valve member 27 which extends beyond the circumference edge of the cylinder 16. Also, the conical spring 30 is effective on the valve member 27 in closing direction. When the release lever 20 is actuated, the valve slide 19 of the release valve 18 is displaced, thereby biasing the lower portion of the valve slide 22 with the pressure of the reservoir via bore 49 in the handle housing 10. The valve slide 22 moves upwardly into the position as shown in FIG. 2 and the space 48 is vented via bore 37 through an opening 50 in the housing cap 23. The pressure or reservoir 17 actuating on the annular portion of valve member 27 from below moves the valve member 27 upwardly against the pressure of the spring 30, the position as shown in FIG. 2. At the same time, the delaying disc 29 is moving downwards under the pressure of the O-ring 31, so that at an intermediate distance, both parts impinge one upon another. The impact is dampened by the knobs 51 on the upper surface of the valve member 27. Thereafter, the unit composed of valve member 27 and delaying disc 29 moves upwards until the axial flange 26 abuts against the valve seat element 25 and the delaying disc 29 against the O-ring 31, respectively. At this point, the upward movement of the valve member 27 and delaying disc 29 is terminated. The air from the reservoir 17 (shown by arrows in FIG. 2) meanwhile fully biases the piston 15 and drives it downwards in a manner known in the art, in order to drive a fastener into a workpiece.

FIG. 3 shows the interception and braking of the driving piston 15 at the end of its stroke. The piston 15 has a conical face 52 moving into the opening defined by the buffer element or ring 43 at the lower end thereof, thus, progressively engaging and deforming the inner bead portion 44 of the buffer ring radially outwardly. At the same time, an axial force is exerted on the buffer ring 43 by the piston 15. Thus, the buffer ring 43 will move downwards, with the lower inner bead portion 44 likewise being progressively deformed radially outwardly by engaging and moving along on the tapered conical face 42 of the guide member 41. This work of deformation normally suffices to dissipate the residual energy remaining in the piston 15 after a fastener has been driven into the workpiece. In the case of a greater residual energy, for example, in the case of free shots, the outer portion of the piston 15 impinges from above against the outer bead portion 45 of the ring 43 so that the lower and the upper outer bead portions will be more or less upset axially. Thereby, the remainder of the residual energy will then effectively be dissipated.

As shown in FIG. 3, during its downward movement, piston 15 forces a portion of the air it pushes ahead of it into an annular space 54 through openings 53. An O-ring 55 is positioned therein to prevent the air from flowing back into the cylinder 16 from the annular space 54. The annular space 54 formed by the cylinder head housing 11 and cylinder 16 is additionally connected via openings 56 to the space below the piston 15, when the piston is in the fully extended and braked position. Via these openings 56, the piston is biased from the underside, in order to be returned to its upper at rest end position, otherwise referred to as the blow-out phase. During the downward movement of the buffer ring 43, the annular space 57 situated therebeneath is positively reduced. The gaps 46*a* formed by the webs or fins 47 (FIG. 4) enables the air to flow upwards out of the annular space 57 and escape into the annular space 54 via the openings 53. Upon relaxation of the buffer ring 43, the ring will move upward again thereby increasing the annular space 57. Thereby, cool air flows from the annular space 54 into the lower annular space 57 and can therefore in this manner sufficiently circulate and cool the buffer ring 43 which is considerably heated by the work of deformation. The dampening member 39 and projection 41 thereon contributes to preventing any pulse-like noises present in the structure from being radiated outwards through the bottom cap 38.

During the return stroke (blow-out phase) the piston 15 forces the air, which is present above itself, upwards and outwards through the perforations 32 as well as through the chambers 33, 34 and the channel 35 and the sound attenuator 36. If the release lever 20 and, thus, the release valve 18 are not actuated, the valves 18 and 21 will again assume the position as shown in FIG. 1. Thereby, the main valve member 27 may close and establish the communication as mentioned between the cylinder space and the atmosphere. Thereby, an entire operating and working cycle has been completed.

Figure 5:
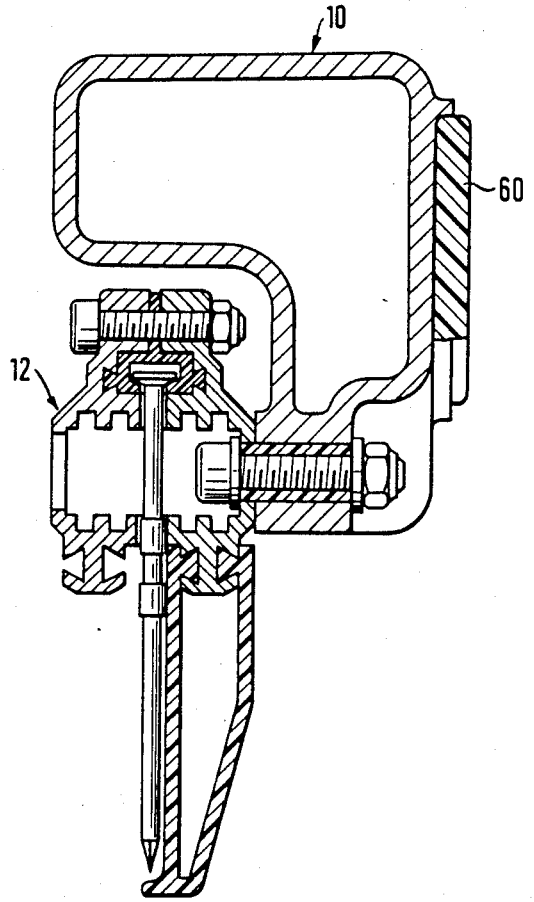
FIG. 5 is a view taken along lines V—V of FIG. 1.

It is not intended to enlarge in particular on the construction of the magazine 12 which is shown in more detail in FIG. 5. It is pointed out that the magazine 12 as shown is designed for nails provided with ahead, which nails are combined to form a magazine strip with the aid of webs of synthetic material. It will furthermore be noted from FIG. 5 that a layer of a sound-dampening material 60 is fitted at the handle housing which dampens sound conducted through solids. Such layers may be fitted in several places, above all, at strongly sound-radiating surfaces and at the same time serve as a protective surface for the apparatus housing to rest on.

I claim:

1. In combination, a braking assembly and a fluid operated fastener driving apparatus, the apparatus having a working cylinder and a substantially closed lower end thereof, a driving plunger guided in the working cylinder and mounted to a driving piston, the driving piston having a mounting portion tapering downwardly towards the driving plunger and a surface portion extending radially outwardly from the mounting portion, the braking assembly comprising a ring shaped buffer element positioned in the closed lower cylinder end and surrounding the driving plunger, said buffer element including two radially spaced inner and outer annular bead portions such that upon the downward movement of the driving piston against said buffer element, the mounting portion thereof engages and deforms said inner annular bead portion radially outwardly and upon the further downward movement of the driving piston, the outer annular bead portion is engaged and axially deformed by said surface portion of the driving piston.

2. The combination in accordance with claim 1 wherein the braking assembly further includes a guide memeber having an outer conical surface positioned between said buffer element and said lower end of the cylinder and said two radially spaced inner and outer bead portions are integrally formed at the underside of said buffer element and said inner bead portion engages and cooperates with said outer conical surface of said guide member when the piston deforms said buffer element at the end of its working stroke.

3. The combination in accordance with claim 1 wherein said outer annular bead portion of said buffer element includes at least one spaced fin on the radial surface thereof lying in close contact against the inner wall of the working piston cylinder to permit air flow therebetween.

4. The combination in accordance with claim 1 wherein said assembly further includes a dampening member composed of a resiliently yielding material positioned at the lower end of the cylinder between said buffer element and said lower end.

5. The combination in accordance with claim 4 wherein said dampening member further includes fins formed on the underside of said dampening member to prevent sound from exiting the driving apparatus.

6. The combination in accordance with claim 5 wherein said apparatus further includes layers of sound dampening material fitted thereon to prevent sound from being conducted therethrough.

* * * * *